United States Patent [19]

Beachy et al.

[11] Patent Number: 4,870,548

[45] Date of Patent: Sep. 26, 1989

[54] CONVERTIBLE LIGHT FIXTURE

[75] Inventors: Robert W. Beachy, St. Paul; Bart T. Ellson, Chanhassen; Jay J. Kakuk, Plymouth, all of Minn.; Gerald E. Peterson, Riverside, Calif.

[73] Assignee: The Toro Company, Minneapolis, Minn.

[21] Appl. No.: 201,713

[22] Filed: Jun. 3, 1988

[51] Int. Cl.[4] ..... F21S 1/00

[52] U.S. Cl. ..... 362/145; 362/431; 362/277; 362/455; 362/429; 439/414

[58] Field of Search ..... 362/145, 152, 302, 431, 362/277, 285, 287, 280, 281, 429, 430, 427, 418, 455, 187, 370, 375; 439/13, 414, 419; 248/156, 530, 545

[56] References Cited

U.S. PATENT DOCUMENTS

| | | | |
|---|---|---|---|
| 1,849,506 | 3/1932 | Rathmann | 362/187 |
| 1,871,389 | 8/1932 | Rathmann | 362/187 |
| 2,338,078 | 12/1943 | Wood | 362/187 |
| 2,339,356 | 1/1944 | Sachs | 362/187 |
| 2,751,568 | 6/1956 | Despard | 439/414 |
| 3,263,069 | 7/1966 | Krucki et al. | 362/439 |
| 3,538,324 | 11/1970 | Hankins | 362/277 |
| 4,286,311 | 8/1981 | Maglica | 362/205 |
| 4,429,351 | 1/1984 | Petzl et al. | 362/277 |
| 4,488,205 | 12/1984 | Quiogue | 362/277 |
| 4,527,223 | 7/1985 | Maglica | 362/187 |
| 4,626,975 | 12/1986 | Miletich | 362/431 |
| 4,638,414 | 1/1987 | de Vos et al. | 362/370 |
| 4,768,139 | 8/1988 | Poppenheimer | 248/530 |
| 4,774,648 | 9/1988 | Kakuk et al. | 362/431 |

*Primary Examiner*—Ira S. Lazarus
*Assistant Examiner*—D. M. Cox
*Attorney, Agent, or Firm*—R. Lawrence Buckley

[57] ABSTRACT

A convertible light fixture (10) capable of selectively functioning as a spotlight or floodlight. A preferred light fixture (10) includes a ground stake (12) supporting a bulb/lens assembly (14). An electrical cable (16), protected by the preferred S-shaped ground stake (12), makes contact with the bulb/lens assembly (14) at the rear thereof. More specifically, a pair of prongs (60), which also support a bulb (62), protrude from the rear of bulb/lens assembly (14) and make contact with electrical cable (16). Preferred bulb/lens assembly (14) includes a stationary housing (40) and a rotatable focus ring (70) wherein rotation of the latter relative to the former causes axial movement of a reflector (80) relative to bulb (62) to change the degree of focus of the light beam produced by fixture (10). Another feature of preferred bulb/lens assembly (14) is a lens (90) which produces a rectangular light beam adjustable in orientation.

8 Claims, 5 Drawing Sheets

CONVERTIBLE LIGHT FIXTURE

FIELD OF THE INVENTION

The invention relates generally to outdoor lighting fixtures, and more particularly to low voltage floodlights and spotlights for outdoor use.

BACKGROUND OF THE INVENTION

The prior art includes many different types of outdoor lighting fixtures, including temple lights, floodlights and spotlights. While temple lights, which typically throw a circle of light directly downward, are certainly useful in many situations, the present invention and the remaining discussion pertain primarily to spotlights and floodlights, often called "spots" and "floods."

Outdoor spots and floods, in contrast to temple lights, produce a fairly concentrated beam which can be directed laterally to illuminate trees, bushes, and various architectural features, for example. A floodlight provides a broader beam which can "flood" a large area with medium intensity light, e.g., for home security. Spotlights, on the other hand, emit a tighter, more concentrated beam capable of brightly illuminating an entryway, house numbers, or any of a wide variety of architectural or garden details. When purchasing an outdoor lighting system, therefore, the homeowner historically had to know, in advance, which lights (spots or floods) to buy and install. This was inconvenient, particularly when conditions changed following initial installation, e.g., when a floodlight was initially suitable in a particular location but subsequently a spotlight would be more appropriate.

Another problem associated with prior art spots and floods was the shape and orientation of their beams. Many prior art spots and floods projected circular beams, for example. While circular beams are adequate in a few situations, most architectural details (e.g., doors, house numbers) and lawn and garden areas and features (trees, walkways, bushes) are more or less rectangular in shape. In view of this, some manufacturers offered spots and floods having rectangular beams. While this was an improvement, these lights were designed such that their beam orientation was fixed relative to the fixture. Thus, a given rectangular-beam light would provide a "vertical" rectangle, or a "horizontal" rectangle, but not both. That is, there was no way to easily convert one type of fixture (producing one beam orientation) to another, particularly after the fixture was installed. This inhibited the ability of the homeowner to switch from illuminating a relatively tall and narrow object (e.g., a door) to illuminating a relatively short and wide object (e.g., a squat flowering bush).

Still another problem associated with prior spots and floods, particularly those supported by a ground stake, is that they don't possess an elegant way to connect the electrical cable to the bulb/lens assembly. Reference is made to FIG. 1 which is a rear perspective view of a typical prior art stake-supported floodlight. As shown in FIG. 1, the cable connects to the bulb/lens assembly (the assembly which houses the bulb and carries the lens) at the rear thereof and runs down the outside of the stake to the ground. Thus, the cable is exposed to the elements and potential abuse by animals, children and vandals. In addition, this design entails a back cover plate, the function of which is to hold the cable in conductive contact with the bulb/lens assembly, and some type of connecter to secure the back cover plate to the main body of the bulb/lens assembly. The back cover plate and connector add to the cost of the light and detract from its appearance.

The present invention addresses the problems associated with prior art spots and floods. In particular, the invention is a convertible light fixture which can function as a spot or flood, as desired. In a preferred embodiment the spot/flood fixture provides a rectangular beam having an adjustable orientation; and unique means for protecting the electrical cable and conductively connecting the cable to the bulb.

SUMMARY OF THE INVENTION

Accordingly, in broad terms, the invention resides in a convertible outdoor light fixture suitable for producing a light beam having an adjustable width. One embodiment of the invention is a convertible light fixture including a bulb/lens assembly; an electrical cable; and means for supporting the bulb/lens assembly, wherein the bulb/lens assembly includes a housing pivotally connected to the bulb/lens assembly supporting means; a bulb; integral bulb holding means for supporting the bulb and making electrical contact to the bulb and to the electrical cable; a focus ring rotatably connected to the housing of the bulb/lens assembly; a lens supported by the focus ring; and a reflector connected to the focus ring. In this embodiment, the reflector forms a bulb aperture suitable for receiving the bulb and rotational movement of the focus ring relative to the housing of the bulb/lens assembly causes axial movement of the focus ring and the reflector relative to the housing and bulb. Those skilled in the art will recognize that axial movement of the reflector relative to the bulb changes the width of the light beam produced by the light fixture.

In a preferred embodiment, the "integral bulb holding means" referred to above is a pair of prongs, each having a sharp cable-piercing end and a bulb-receiving end comprising multiple leaves which springingly bear against the bulb base to hold the bulb and electrically contact one of the bulb leads.

Another preferred feature is a "curved surface" on the bulb/lens assembly supporting means, wherein the housing of the bulb/lens assembly joins the curved surface of the supporting means to form a cable aperture for receiving the electrical cable. When the bulb/lens assembly is pivoted relative to the supporting means the cable remains confined within the cable aperture and electrical contact to the cable is maintained. The cable-piercing ends of the prongs extend out of the housing of the bulb/lens assembly into the cable aperture to make piercing contact with the electrical cable.

Another preferred feature is use of a lens which produces a rectangular light beam. And, preferably the lens can be rotated relative to the focus ring (and reflector and bulb) to alter the orientation of the rectangular beam produced by the light fixture. Although several designs for such a lens are contemplated, a preferred design involves use of a lenticular lens which includes a plurality of rectangular pillow optics or optical elements.

A preferred embodiment of the invention will be further described with reference to the Drawing.

BRIEF DESCRIPTION OF THE DRAWING

A preferred embodiment of the invention is shown in the appended Drawing, wherein.

DETAILED DESCRIPTION OF PREFERRED EMBODIMENT

Figure 1:
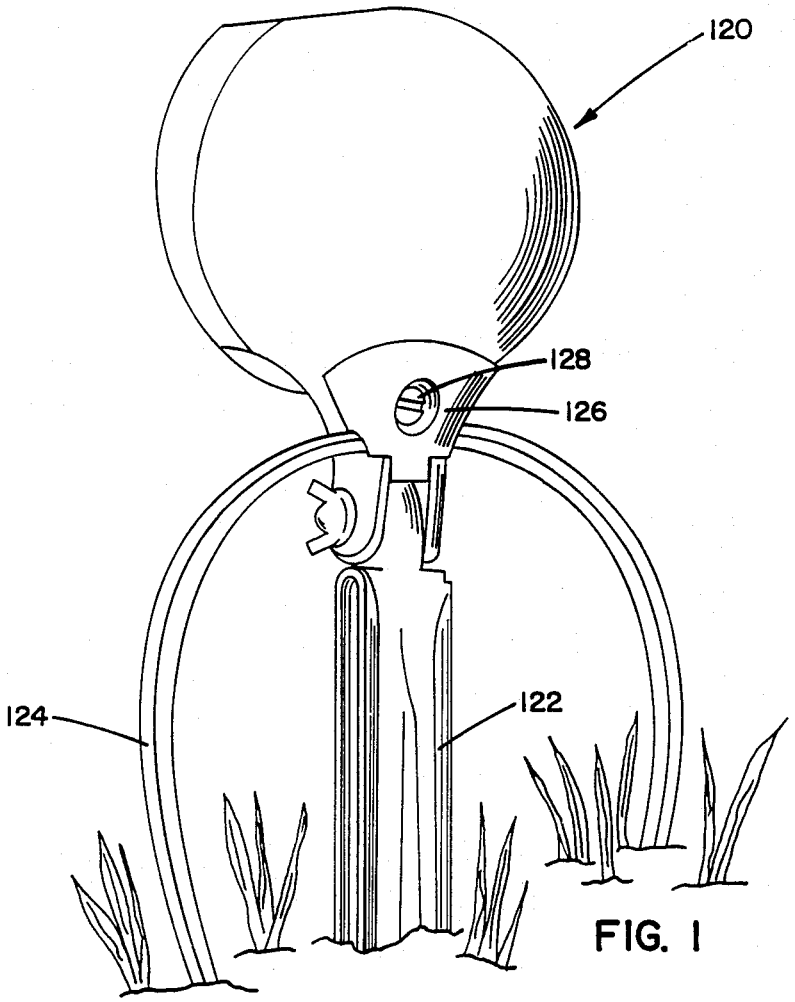
FIG. 1 PRIOR ART
FIG. 1 is a rear perspective view of a prior art floodlight.
Figure 2:
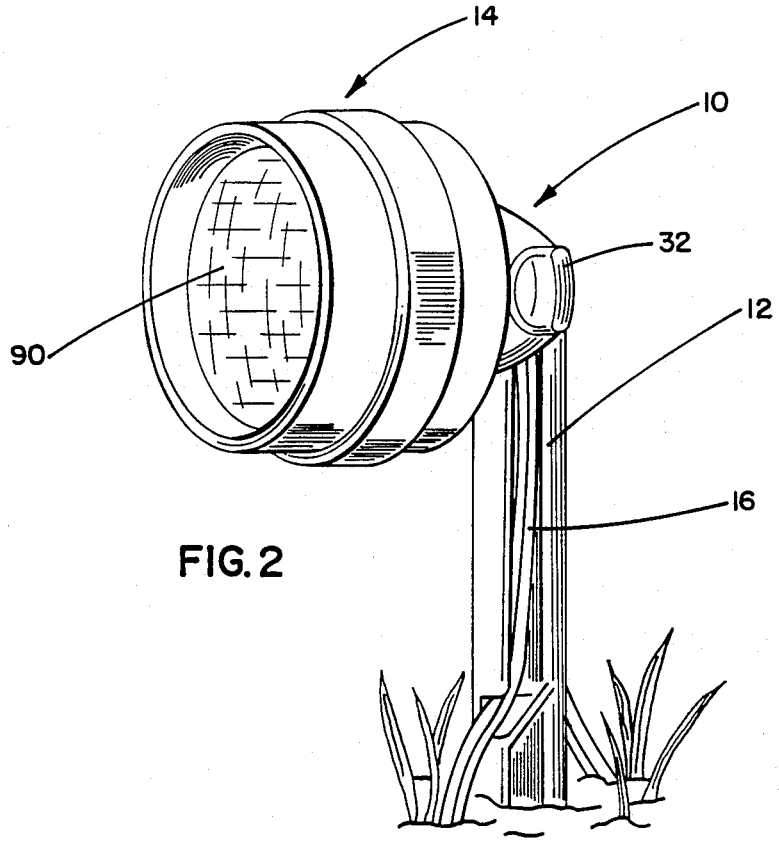
FIG. 2 is a front perspective view of a light fixture according to the invention.

A preferred embodiment of the invention, including all of the various aspects of the invention, will now be described. With reference to the Drawing, wherein like reference numerals designate like parts and assemblies throughout the several views, FIG. 2 shows a preferred light fixture 10 according to the invention, inserted into the ground. Light fixture 10 includes three basic components, i.e., a ground stake 12; a bulb/lens assembly 14 supported by ground stake 12; and an electrical cable 16 which provides electrical energization to the bulb/lens assembly 14. Cable 16 can be connected to a low voltage power supply (not shown) capable of providing about 12 VAC. As further described below, preferred ground stake 12 pivotally supports bulb/lens assembly 14 such that the latter can pivot in a vertical plane. Also as described further below, ground stake 12 is designed such that a very simple connection between bulb/lens assembly 14 and electrical cable 16 can be made and such that cable 16 is well protected from damage and abuse.

Figure 3:
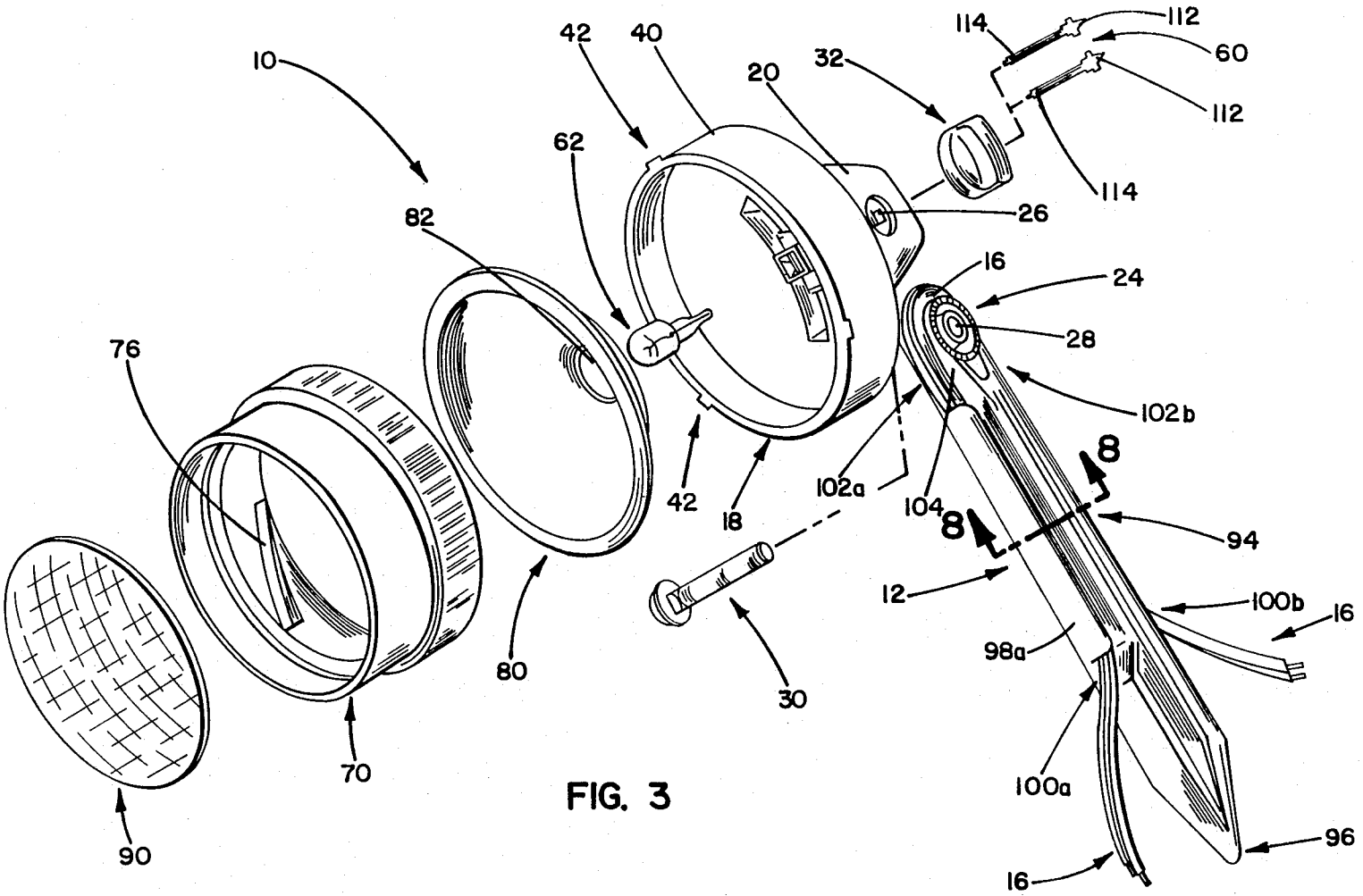
FIG. 3 is an exploded view of the light fixture of FIG. 2.

FIG. 3 shows an exploded view of light fixture 10. Bulb/lens assembly 14 of light fixture 10 includes a substantially circular housing 18 which connects to stake 12. The connection to stake 12 is made by way of a U-shaped yoke 20 which extends rearwardly from a dish-like rear wall 22 of housing 18 (see FIG. 6). Yoke 20 straddles head 24 of stake 12, and a first bolt aperture 26 formed by yoke 20 and a second bolt aperture 28 formed by head 24 align to receive a carriage bolt 30. A knob 32 threads on the end of bolt 30 to complete the assembly. Bolt aperture 26 is preferably square in at least one of the yoke portions so that knob 32 can be loosened and tightened without the necessity of holding bolt 30. Once knob 32 is loosened, housing 18 (and the entire bulb/lens assembly 14) can be pivoted upward and downward in a vertical plane about an imaginary axis passing through bolt 30. When housing 18 is repositioned as desired, knob 32 is retightened. This draws the opposing portions of yoke 20 into frictional contact with head 24 of stake 12 so as to securely hold housing 18 (and the entire bulb/lens assembly 14) in the desired position.

Figure 6:
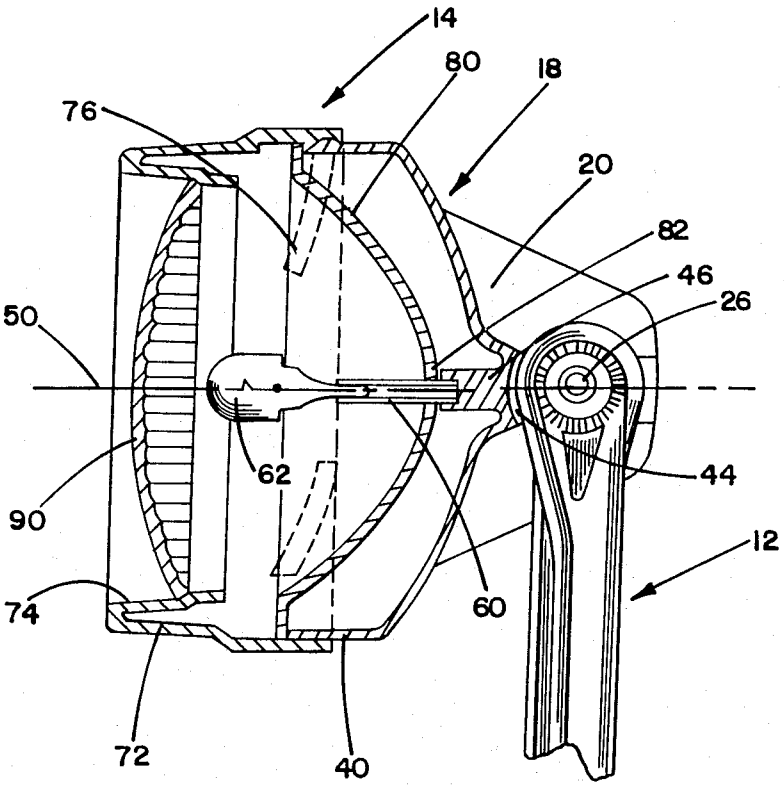
FIG. 6 is a sectional view of the bulb/lens assembly of the light fixture of FIG. 2, taken substantially along line 6,7—6,7 shown in FIG. 4, showing the focus ring at one extreme.

As shown in FIGS. 3 and 6, housing 18 also includes a circular housing ring 40 which extends forwardly from the outer periphery of rear wall 22. The outer surface of housing ring 40 forms three small outwardly-extending tabs 42, spaced at 120° intervals, the function of which will be described below. Toward the center of rear wall 22 is a frusto-conical rear extension 44 which forms a centrally-apertured somewhat tubular prong holder 46 extending forwardly along an imaginary axis 50 (about which bulb/lens assembly 14 is substantially symmetrical). Prong holder 46 is apertured in two relatively-insulated places to receive a pair of prongs 60 which support and conductively contact a bulb 62. Preferably, prongs 60 are substantially identical to the prongs disclosed in copending and commonly-owned patent application Ser. No. 07-050,842 filed on May 15, 1987, now U.S. Pat. No. 4,774,648, incorporated herein by reference. Thus, bulb 62 is fixed relative to housing 18 of bulb/lens assembly 14, the significance of which will be explained below. Bulb 62 carries a small metallic, e.g., aluminum, cap 63 which covers roughly the entire front half thereof. Cap 63 includes three small fingers 65 which are radially inwardly spring-biased to grip the back surface of bulb 62, thereby holding cap 63 in place. Cap 63 prevents light from going directly from bulb 62 through lens 90, instead causing all of the light to first reflect off of reflector 80. When reflector 80 is parabolic, this generally results in parallel rays passing through lens 90, assuming the center of bulb 62 is roughly at the focal point of reflector 80.

Figure 7:
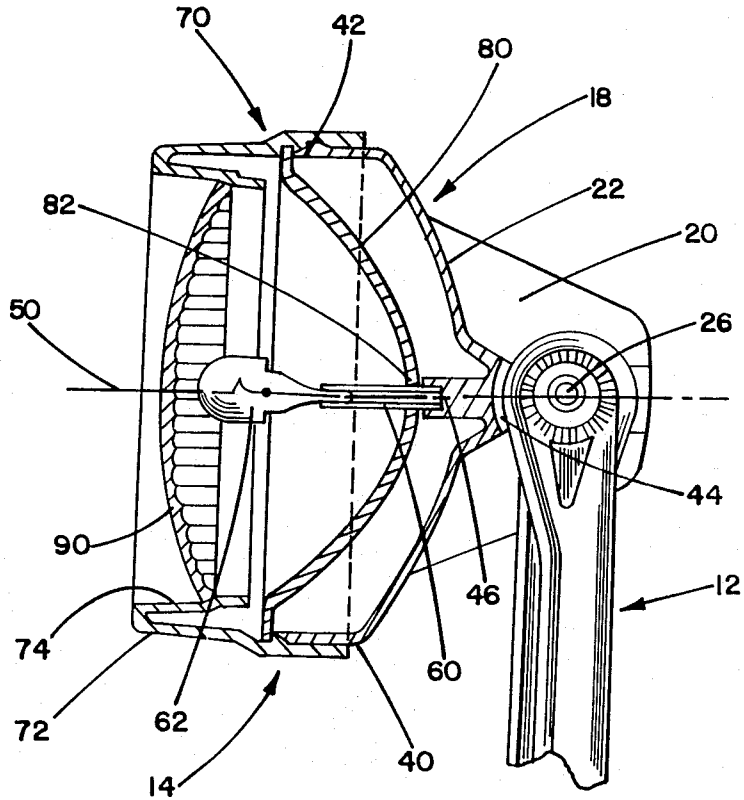
FIG. 7 is a sectional view of the bulb/lens assembly of the light fixture of FIG. 2, taken substantially along line 6,7—6,7 shown in FIG. 4, showing the focus ring at the other extreme.

A movable focus ring 70 is rotatably supported by housing 18. Referring to FIG. 6, focus ring 70 includes a circular outer wall 72 and a smaller diameter, somewhat conical, circular inner wall 74 wherein walls 72 and 74 join at the forward edge of focus ring 70. Outer wall 72 forms three spiral grooves 76 shown in FIGS. 3, 6 and 7, grooves 76 being configured to receive tabs 42 extending outwardly from housing ring 40. A slip fit exists between outer wall 72 of focus ring 70 and housing ring 40. And, due to the interaction between spiral grooves 76 and tabs 42, when focus ring 70 is rotated relative to housing 18 it moves axially (along axis 50) relative to housing 18 and bulb 62.

At a point slightly forward of spiral grooves 76, the inner surface of focus ring outer wall 72 also holds a parabolic reflector 80. Wall 72 is relieved to form a circular groove which receives reflector 80. Reflector 80 forms a central bulb aperture 82 suitable for receiving prongs 60 and bulb 62. While reflector 80 can be of virtually any type, preferably reflector 80 is vacuum-metallized polycarbonate, and has a focal length of about 0.75 inch and a contour corresponding to the equation $y^2=3x$. Bulb aperture 82 is preferably 1.25 inch in diameter.

When focus ring 70 is rotated relative to housing 18 and, therefore, moved axially relative thereto, reflector 80 also moves axially relative to housing 18 and bulb 62. With reflector 80 in its rearmost position its focal point coincides with the effective center of bulb 62. This produces a focused "spot" beam which is about 2 feet wide and 5 feet tall on a surface about 8 feet from lens 90. The forwardmost position of reflector 80 is about 0.375 inch forward of the rearmost position. In this state, light fixture 10 produces more of a "flood" beam of 6 by 8.5 feet on a surface about 8 feet from lens 90. Of course, reflector 80 can be smoothly adjusted to positions intermediate the extreme positions discussed above, so that light 10 produces beams having proportionally smaller or larger dimensions.

Completing bulb/lens assembly 14 is a substantially transparent lens 90 which is held in position by three latch hooks 91 extending rearwardly therefrom which snap over the rearmost edge 93 of focus ring inner wall 74. The natural radial resiliency of hooks 91 causes their free ends 95 to snap outward once they go beyond edge 93, and enlarged ends 95 bearing against edge 93 axially fixes lens 90 relative to focus ring 70. Although latch hooks 91 prevent lens 90 from being axially removed from focus ring 70, lens 90 can rotate about axis 50 relative to focus ring 70. Preferred lens 90 is a polycarbonate lenticular lens made up of a plurality of small rectangular pillow optics or optical elements stacked tightly together in rows and columns. Each small optical element is about 0.4 inch by 0.2 inch and has two distinct radii of curvature, 1.25 inch and 0.275 inch, the latter running along the short side of the optical element and the former running along the long side of the optical element. Each optical element produces a small rectangular beam which combines with the beams from the other optical elements to produce a single large rectangular beam. The overall spherical radius of lens 90 is preferably about 4.50 inches and the planar diameter of lens 90 is preferably about 3.9 inches.

Thus, lens 90 is of the type which produces a rectangular beam despite the fact that it and reflector 80 are round. When lens 90 is rotated about axis 50, the orientation of the rectangular beam changes. Lens 90 can be infinitely adjusted to provide the desired orientation.

Figure 8:
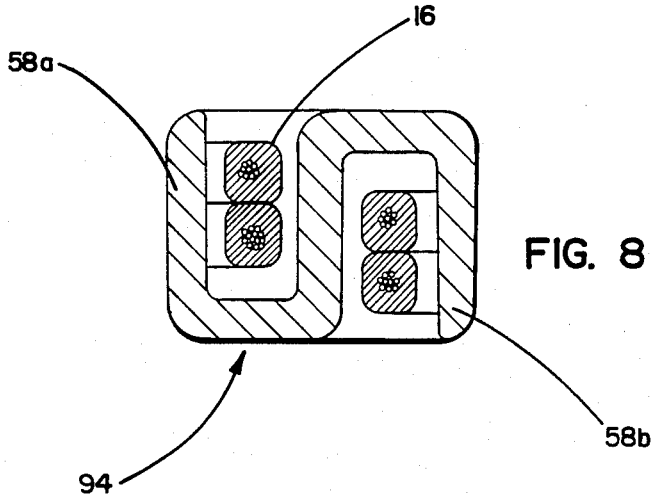
FIG. 8 is a sectional view of the stake of the light fixture of FIG. 2, taken generally along line 8—8 shown in FIG. 3.

Referring again to FIG. 3, head 24 of stake 12 is supported by an elongated substantially S-shaped middle portion 94, the preferred cross section of which is shown in FIG. 8. At the very bottom of stake 12 is a stake point 96 which enables the stake 12 to be easily inserted into the ground. Toward the bottom of middle portion 94, but above point 96, in each outer wall 98 thereof, is a lower cable aperture 100. Similarly, adjacent head 24 is a pair of upper cable apertures 102 also formed in outer walls 98 of stake middle portion 94.

Figure 5:
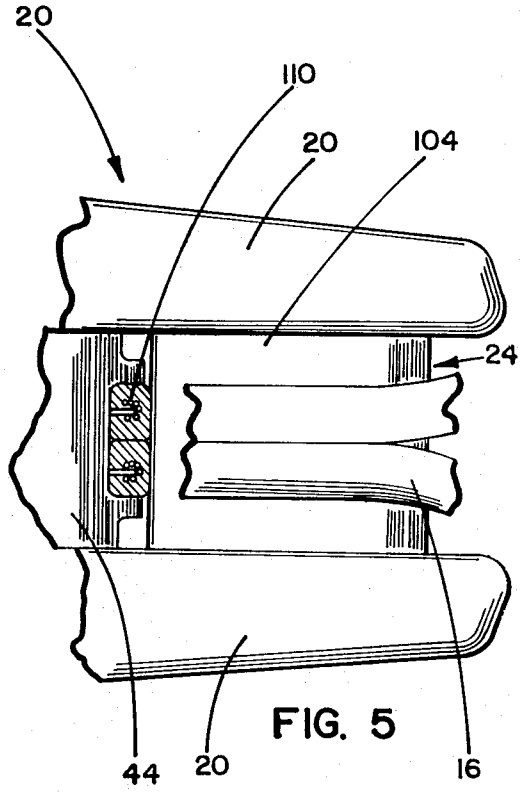
FIG. 5 is an enlarged top plan view of a portion of the light fixture of FIG. 2.
Figure 4:
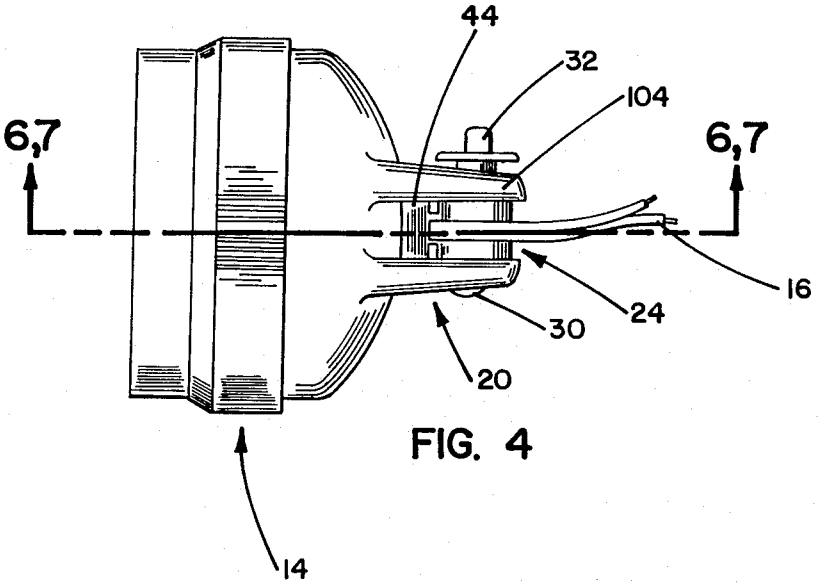
FIG. 4 is a top plan view of the light fixture of FIG. 2.

Head 24 of stake 12 forms a horizontal axis cylindrical surface 104 concentric with bolt apertures 26 and 28. Surface 104 preferably has a radius of about 0.5 inch. As shown in FIGS. 4 and 5, U-shaped rear extension 44 of bulb/lens assembly housing 18 adjoins cylindrical surface 104, thus forming an aperture 110 suitable for receiving cable 16. Because cylindrical surface 104 of stake 12 is concentric with bolt apertures 26 and 28, vertical pivoting of bulb/lens assembly 14 relative to stake 12 does not affect the integrity of the connection between prongs 60 and cable 16. That is, closed aperture 110 is maintained regardless of the angular position of bulb/lens assembly 14, and cable 16 is not allowed to escape. Depending on the direction of the pivoting, parts of cable 16 is pushed and part is pulled, but assuming some slack was retained on both sides of cable 16 during installation, this shouldn't pose a problem.

Thus, cable 16 is threaded through stake 12 as follows: in through lower cable aperture 100*a*; up middle portion 94; out upper cable aperture 102*a*; around cylindrical surface 104 of head 24; in upper cable aperture 102*b*; down middle portion 94; and finally out lower cable aperture 100*b*. It should be noted that apertures 100, 102 are actually three-sided rectangular slots such that cable 16 can be hidden within stake 12 after the electrical connection to prongs 60 is made. As lower cable apertures 100 would normally be either underground or slightly above ground level, and middle portion 94 is shaped to substantially surround cable 16 as shown in FIG. 8, cable 16 is well protected.

As shown in FIG. 3 and as described in commonly-owned application Ser. No. 07-050,842 filed on May 15, 1987, incorporated herein by reference, prongs 60 include rearwardly-directed points 112 suitable for piercing the insulation of cable 16 and making conductive contact with the stranded wire therein. At the forward ends of prongs 60 are bulb holding portions 114 which frictionally hold and conductively contact bulb 62. Each bulb holding portion 114 is in the nature of a three-sided box consisting of a pair of side leaves and an end leaf. The natural resilience of the leaves causes them to grip the base of bulb 62 and make conductive contact with the bulb leads which extend out of the bulb to the outer surface of the bulb housing. The three-sided "boxes" formed by the two bulb holding ends 114 face one another, so that both sides and both outer edges of the bulb base are firmly held.

FIG. 5 illustrates how prong points 112 protrude through the back of bulb/lens assembly housing 18 and make contact with electrical cable 16 which is captive within cable aperture 110.

The assembly and installation procedure for light fixture 10 is as follows:

Prior to connecting lens/bulb assembly 14 to stake 12, cable 16 is positioned over prong points 112 protruding from the back of housing 18. Next, stake 12 is snapped into the rear of bulb/lens assembly 14 such that head 24 of stake 12 resides between the two rearwardly extending portions of yoke 20 and so that bolt aperture 28 aligns with bolt aperture 26. The assembly of bulb/lens assembly 14 to stake 12 causes stake cylindrical surface 104 to push cable toward prong points 112 so that they penetrate the insulation of cable 16 and make conductive contact with the metallic conductor therein. As noted above, cable 16 should be somewhat slack to allow for pivoting of bulb/lens assembly 14 relative to stake 12. Once these two major components are snapped together, bolt 30 can be inserted through the aligned apertures 26 and 28 and knob 32 threaded onto the end of bolt 30. Cable 16 can then be routed through apertures 100, 102 and the inner cavities of stake middle portion 94 so that cable 16 is well protected from the elements, children, animals and the like. Stake 12 can then be inserted into the ground and cable 16 buried. A suitable low voltage power supply (not shown) can be connected to cable 16 to provide power to bulb 62.

Once light fixture 10 is installed it is an easy matter to adjust the beam orientation and/or degree of focus. As discussed above, the beam orientation is adjusted simply by rotating lens 90 relative to focus ring 70. To adjust the width or focus of the light beam it is simply necessary to rotate focus ring 70 relative to housing 18.

It should be noted that the preferred material for the components of fixture 10, unless stated otherwise above, is polypropylene, with injection molding being the fabrication technique of choice. Also, bulb/lens assembly 14 can be supported by components other than a ground stake. For example, a deck mount could be employed.

A preferred embodiment of the invention is described above. Those skilled in the art will recognize that many embodiments are possible within the scope of the invention. Variations and modifications of the various parts and assemblies can certainly be made and still fall within the scope of the invention. Thus, the invention is limited only to the apparatus and method recited in the following claims, and equivalents thereto.

We claim:

1. A convertible outdoor light fixture suitable for producing a light beam having an adjustable width, comprising:
(a) a bulb/lens assembly;
(b) an electrical cable operatively connected to the bulb/lens assembly; and
(c) means for supporting the bulb/lens assembly, wherein the bulb/lens assembly comprises:
(i) a housing pivotally connected to the supporting means;
(ii) a bulb comprising a base and a pair of leads;
(iii) integral bulb holding means fixedly received by the housing for mechanically supporting the bulb and conductively coupling the bulb and the electrical cable, the bulb holding means comprising a pair of prongs suitable for piercing the cable and supporting the bulb, each prong comprising a sharp cable-piercing end and a bulb-receiving end comprising multiple leaves which springingly bear against the bulb base to hold the bulb and electrically contact one of the bulb leads;
(iv) a focus ring rotatably connected to the housing;
(v) a lens operatively supported by the focus ring; and
(vi) a reflector connected to the focus ring, wherein the reflector forms a bulb aperture suitable for receiving the bulb, wherein rotational movement of the focus ring relative to the housing causes axial movement of the focus ring and reflector relative to the housing and bulb, and wherein the bulb/lens assembly supporting means comprises a curved surface; the bulb/lens assembly housing is configured to join the curved surface to form a cable aperture for receiving the electrical cable; and the pointed cable-piercing ends of the prongs extend out of the housing into the cable aperture to make piercing conductive contact with the electrical cable.

2. A convertible outdoor light fixture suitable for producing a light beam having an adjustable width, comprising:
(a) a bulb/lens assembly;
(b) an electrical cable operatively connected to the bulb/lens assembly; and
(c) means for supporting the bulb/lens assembly, wherein the bulb/lens assembly comprises:
(i) a housing pivotally connected to the supporting means;
(ii) a bulb;
(iii) integral bulb holding means fixedly received by the housing for mechanically supporting the bulb and conductively coupling the bulb and the electrical cable;
(iv) a focus ring rotatably connected to the housing;
(v) a lens operatively supported by the focus ring; and
(vi) a reflector connected to the focus ring, wherein the reflector forms a bulb aperture suitable for receiving the bulb, wherein rotational movement of the focus ring relative to the housing causes axial movement of the focus ring and reflector relative to the housing and bulb, and wherein the reflector and the lens are round but the lens produces a rectangular light beam.

3. The light fixture of claim 2, wherein the lens can be rotated relative to the focus ring to change the orientation of the rectangular beam.

4. The light fixture of claim 3, wherein the lens is lenticular and comprises a plurality of rectangular optical elements.

5. A convertible outdoor light fixture suitable for producing a light beam having an adjustable width, comprising:
(a) a bulb/lens assembly;
(b) an electrical cable operatively connected to the bulb/lens assembly; and
(c) means for supporting the bulb/lens assembly, wherein the bulb/lens assembly comprises:
(i) a housing pivotally connected to the supporting means;
(ii) a bulb;
(iii) integral bulb holding means fixedly received by the housing for mechanically supporting the bulb and conductively coupling the bulb and the electrical cable;
(iv) a focus ring rotatably connected to the housing;
(v) a lens operatively supported by the focus ring; and
(vi) a reflector connected to the focus ring, wherein the reflector forms a bulb aperture suitable for receiving the bulb, wherein rotational movement of the focus ring relative to the housing causes axial movement of the focus ring and reflector relative to the housing and bulb, and wherein the housing comprises a tab extending radially outward therefrom, and the focus ring forms a spiral groove in its inner surface for receiving the tab, whereby rotational movement of the focus ring relative to the housing results in axial movement of the focus ring relative to the housing.

6. A convertible outdoor light fixture suitable for connecting to an electrical cable and producing a light beam having an adjustable width rectangular beam, comprising:
(a) a bulb/lens assembly; and
(b) means for supporting the bulb/lens assembly, wherein the bulb/lens assembly comprises:
(i) a housing pivotally connected to the supporting means;
(ii) a bulb;
(iii) means for holding the bulb and conductively connecting the bulb to the electrical cable;
(iv) a focus ring connected to the housing in such a manner that rotation of the focus ring relative to the housing results in axial movement of the focus ring relative to the housing;
(v) a lens capable of producing a rectangular light beam rotatably supported by the focus ring; and
(vi) a reflector connected to the focus ring, wherein the reflector forms an aperture suitable for receiving the bulb, and the width of the light beam can be adjusted by rotating the focus ring relative to the housing to cause axial movement of the reflector relative to the bulb; and wherein the lens can be rotated relative to the focus ring to change the angular orientation of the rectangular beam relative to the housing.

7. A convertible outdoor light fixture suitable for producing a rectangular light beam having an adjustable width and orientation, comprising:

(a) a bulb/lens assembly;

(b) an electrical cable operatively connected to the bulb/lens assembly; and (c) a ground stake having a pointed end suitable for insertion into the ground, a S-shaped intermediate portion, and a head having a curved surface, wherein the bulb/lens assembly comprises:

(i) a housing pivotally connected to the ground stake, wherein the housing forms a yoke which connects to the head of the ground stake; the housing and the curved surface of the ground stake head form a cable aperture for receiving the electrical cable; and the housing forms a radially extending tab;

(ii) a bulb having a base and a pair of leads;

(iii) a pair of integral prongs, each prong having a sharp cable-piercing end suitable for making piercing conductive contact with the electrical cable, and a multi-leaved bulb holding end suitable for supporting the base of the bulb and for making conductive contact with one of the bulb leads, wherein the prongs are fixedly received by a pair of prong apertures in the housing such that the cable-piercing ends protrude from the housing into the cable aperture to make conductive contact with the cable therein;

(iv) a focus ring rotatably connected to the housing, wherein the focus ring forms a spiral groove suitable for receiving the housing tab, whereby rotation of the focus ring relative to the housing causes axial movement of the focus ring relative thereto;

(v) a lenticular lens rotatably supported by the focus ring, wherein the lens comprises a plurality of rectangular optical elements each suitable for creating a rectangular light beam, and wherein rotation of the lens relative to the focus ring changes the orientation of the rectangular light beam produced by the light fixture relative to the housing; and (vi) a parabolic reflector axially fixed to the focus ring, wherein the reflector forms a bulb aperture suitable for receiving the bulb, and wherein the width of the light beam produced by the light fixture can be adjusted by rotation of the focus ring relative to the housing which results in axial movement of the parabolic reflector relative to the bulb.

8. A convertible outdoor light fixture suitable for connecting to an electrical cable and producing a light beam having an adjustable width rectangular beam, comprising:

(a) a bulb/lens assembly; and (b) means for supporting the bulb/lens assembly, wherein the bulb/lens assembly comprises:

(i) a housing operatively connected to the supporting means;

(ii) a bulb;

(iii) means fixed to the housing for holding the bulb and conductively connecting the bulb to the electrical cable;

(iv) a lens capable of producing a rectangular beam; and (v) a reflector assembly operatively connected to the housing, wherein the reflector assembly forms an aperture suitable for receiving the bulb and axial movement of the reflector assembly relative to the bulb changes the width of the light beam; and wherein the reflector assembly rotatably supports the lens and rotation of the lens relative to the housing changes the angular orientation of the rectangular beam relative to the housing.

* * * * *